US011535050B2

(12) United States Patent
Mizutori

(10) Patent No.: US 11,535,050 B2
(45) Date of Patent: Dec. 27, 2022

(54) RETRACTIVE WRITING UTENSIL

(71) Applicant: ZEBRA CO., LTD., Tokyo (JP)

(72) Inventor: Masataka Mizutori, Tokyo (JP)

(73) Assignee: ZEBRA CO., LTD., Tokyo (JP)

( * ) Notice: Subject to any disclaimer, the term of this patent is extended or adjusted under 35 U.S.C. 154(b) by 0 days.

(21) Appl. No.: 17/536,575

(22) Filed: Nov. 29, 2021

(65) Prior Publication Data

US 2022/0184996 A1 Jun. 16, 2022

(30) Foreign Application Priority Data

Dec. 11, 2020 (JP) ..... JP2020-205885

(51) Int. Cl.

| | |
|---|---|
| ***B43K 24/12*** | (2006.01) |
| ***B43K 7/00*** | (2006.01) |
| ***B43K 27/00*** | (2006.01) |
| ***B43K 24/10*** | (2006.01) |
| ***B43K 24/16*** | (2006.01) |

(52) U.S. Cl.

CPC ..... *B43K 24/12* (2013.01); *B43K 7/005* (2013.01); *B43K 27/006* (2013.01); *B43K 24/10* (2013.01); *B43K 24/16* (2013.01); *B43K 24/163* (2013.01)

(58) Field of Classification Search

CPC ..... B43K 24/12; B43K 7/005; B43K 27/006; B43K 24/00; B43K 24/02; B43K 24/04; B43K 24/08; B43K 24/082; B43K 24/10; B43K 24/16; B43K 24/163; B43K 27/08; B43K 27/12

USPC ..... 401/29–33, 109–114

See application file for complete search history.

(56) References Cited

U.S. PATENT DOCUMENTS 5,599,122 A * 2/1997 Yu ..... B43K 24/12 401/99

10,507,687 B1 * 12/2019 Hill, III ..... B43K 29/18

FOREIGN PATENT DOCUMENTS

JP 2005111876 A 4/2005

* cited by examiner

*Primary Examiner* — David J Walczak

(74) *Attorney, Agent, or Firm* — Greenblum & Bernstein, P.L.C.

(57) ABSTRACT

A retractive writing utensil includes a shaft tube, a core stored in the shaft tube in such a manner as to protrude from a front end of the shaft tube when moved forward, and an urging member that is stretched and contracted in the shaft tube in a front-rear direction, wherein the urging member is located adjacent to the core radially outward in such a manner that the center of the urging member is positioned radially outside the core, and urges the core rearward.

8 Claims, 6 Drawing Sheets

RETRACTIVE WRITING UTENSIL

BACKGROUND OF THE INVENTION

1. Field of the Invention

The present invention relates to a retractive writing utensil in which a core stored in a shaft tube is moved forward so as to protrude from a front end of the shaft tube.

2. Description of the Related Art

This type of a conventional writing utensil includes, as described in Japanese Patent Publication Laid-open No. 2005-111876, for example, a shaft tube, a plurality of cores stored in the shaft tube in such a manner as to protrude from a front end of the shaft tube when moved forward, a plurality of compression coil springs mounted annularly on the plurality of cores respectively, slide operation bodies connected integrally to the plurality of cores respectively, and a divider inserted into each of the plurality of cores without interfering therewith, wherein one slide operation body is selected from the plurality of slide operation bodies and operated to move forward, so that the core corresponding to the slide operation body is moved forward against an urging force of the compression coil springs to protrude from the front end of the shaft tube.

Examples of the cores include a ballpoint pen core with a ballpoint pen tip thereof connected to the front end side of an ink tank, and a mechanical pencil core with a lead core feeding mechanism connected to the front end side of a core tank.

Incidentally, in recent years, as to ballpoint pen cores in particular, products with a higher ink flow rate than the conventional ones for the purpose of improving the writing quality and the like have become popular. Since the ink capacities are relatively large in such ballpoint pen cores, the outer diameters of the ink tanks are made large. Also, with mechanical pencil cores as well, the outer diameters of the core tanks need to be enlarged in order to increase the lead core capacity.

SUMMARY OF THE INVENTION

However, in increasing the outer diameters of the ink tanks or core tanks to be greater than those of the conventional ones, the inner/outer diameters of the compression coil springs mounted annularly on the ink tanks or core tanks need to be increased.

In view of these problems, the present invention includes the following configuration.

A retractive writing utensil that includes a shaft tube, a core stored in the shaft tube in such a manner as to protrude from a front end of the shaft tube when moved forward, and an urging member that is stretched and contracted in a front-rear direction in the shaft tube, wherein the urging member is located adjacent to the core radially outward in such a manner that a center of the urging member is positioned radially outside the core, and urges the core rearward.

Owing to the configuration described above, the present invention can prevent the diameter of the urging member from becoming dependent on the outer diameter of the core.

DESCRIPTION OF THE PREFERRED EMBODIMENTS

The present embodiment discloses the following features.

A first feature includes a shaft tube, a core stored in the shaft tube in such a manner as to protrude from a front end of the shaft tube when moved forward, and an urging member that is stretched and contracted in a front-rear direction in the shaft tube, wherein the urging member is located adjacent to the core radially outward in such a manner that a center of the urging member is positioned radially outside the core, and urges the core rearward (see FIGS. 1 to 6).

Figure 1:
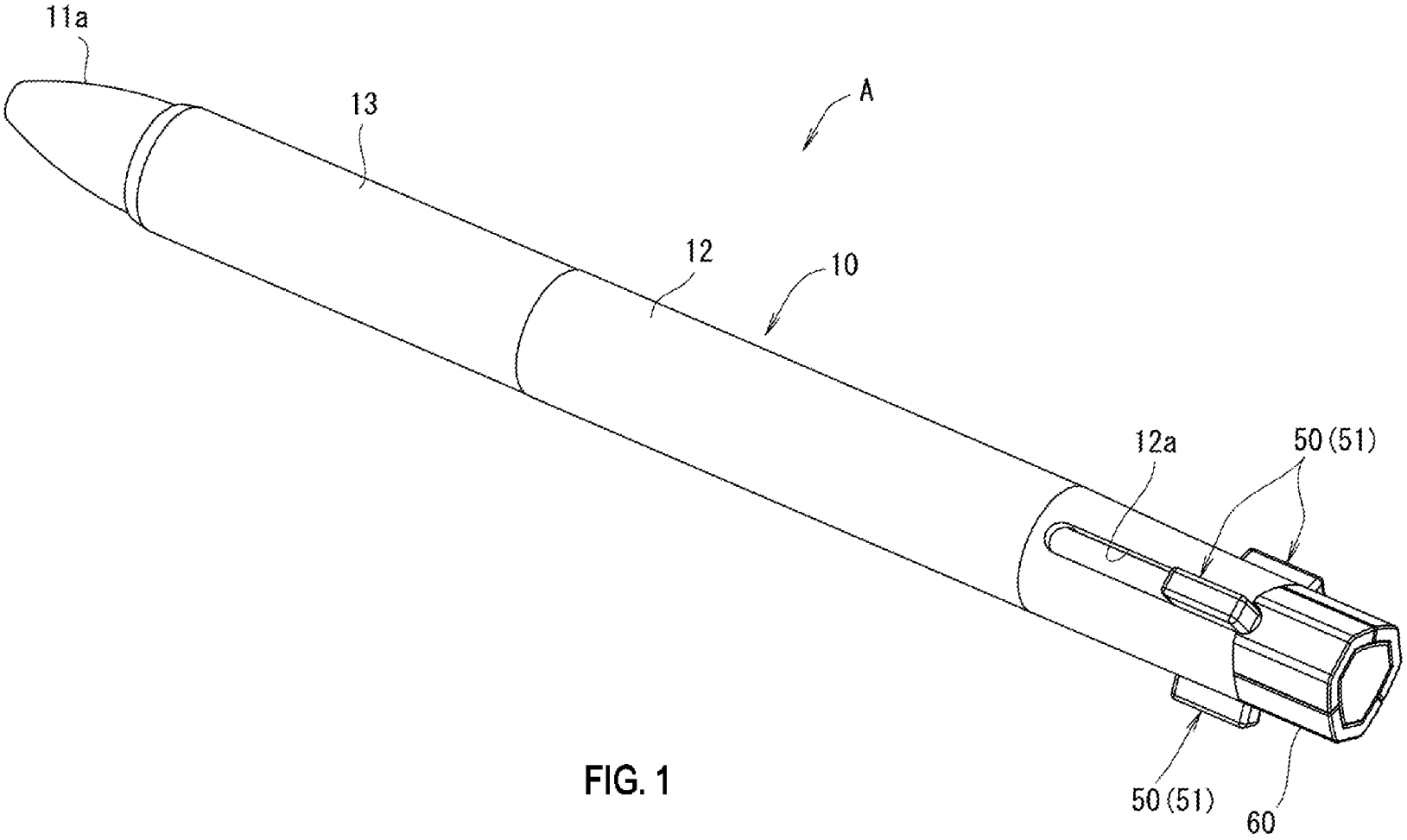
FIG. 1 is a perspective view showing an example of the retractive writing utensil according to the present invention.
Figure 2:
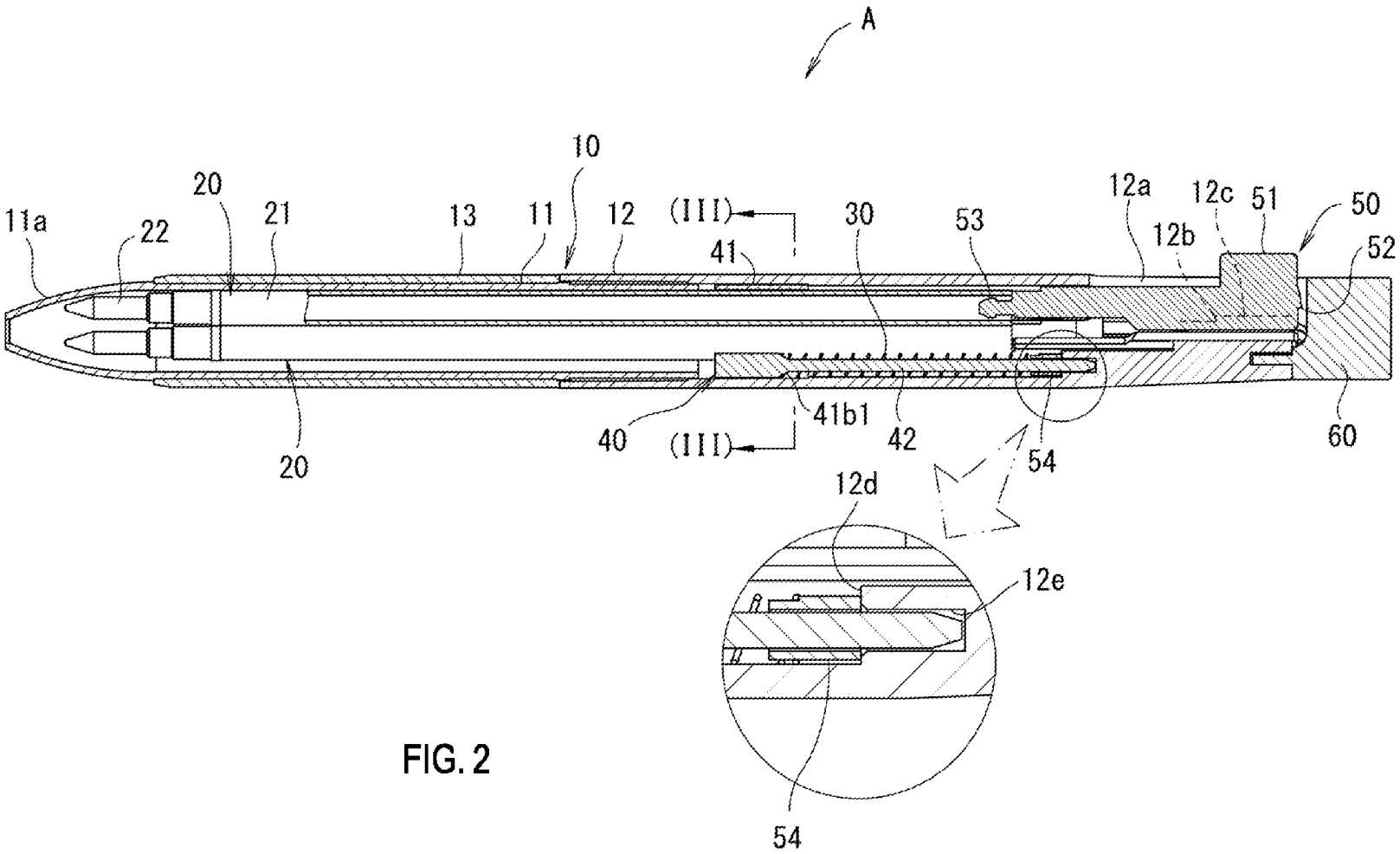
FIG. 2 is a vertical cross-sectional diagram of the retractive writing utensil.
Figure 3:
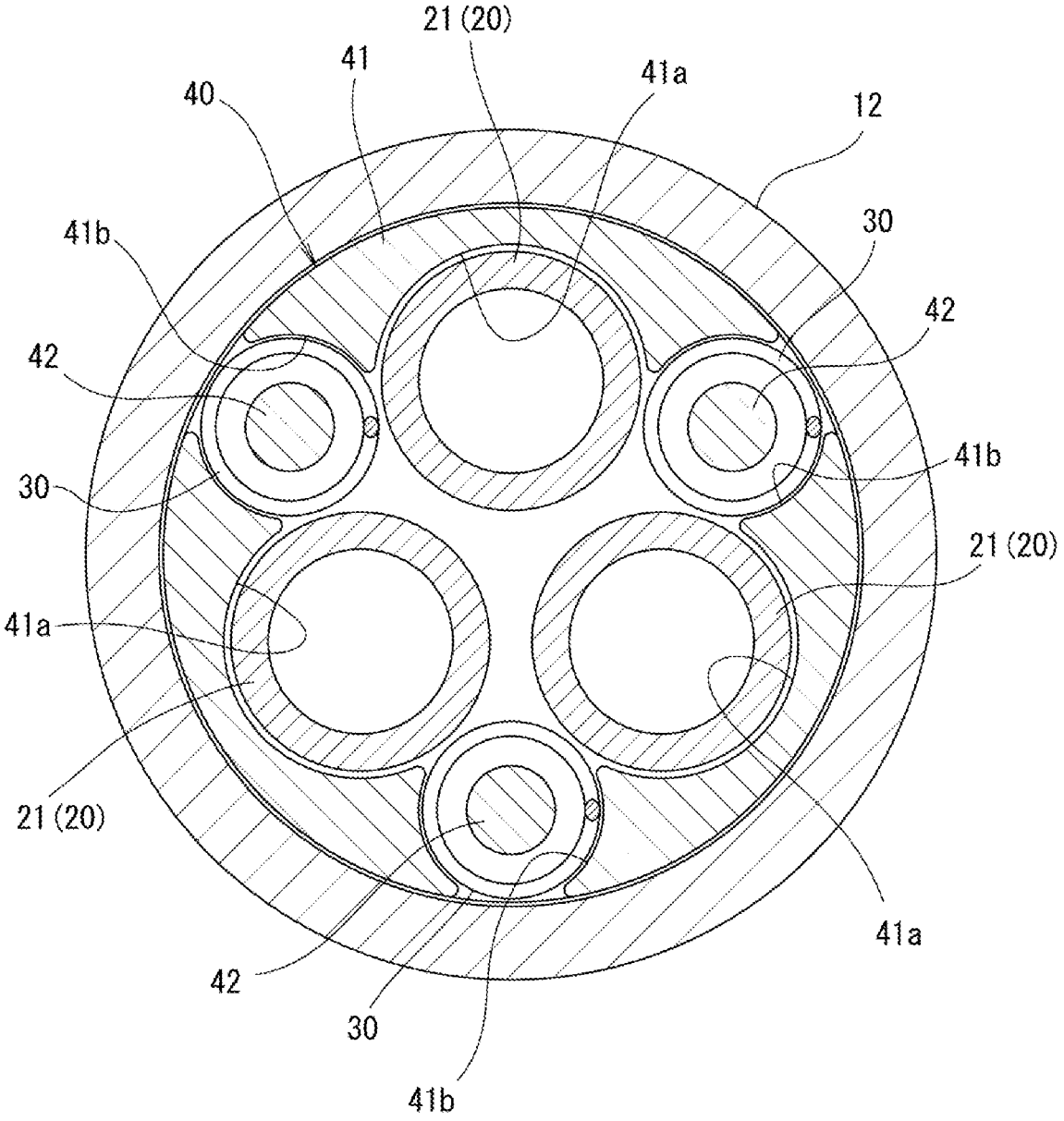
FIG. 3 is a horizontal cross-sectional diagram of the retractive writing utensil, taken along line (III)-(III) of FIG. 2.
Figure 4:
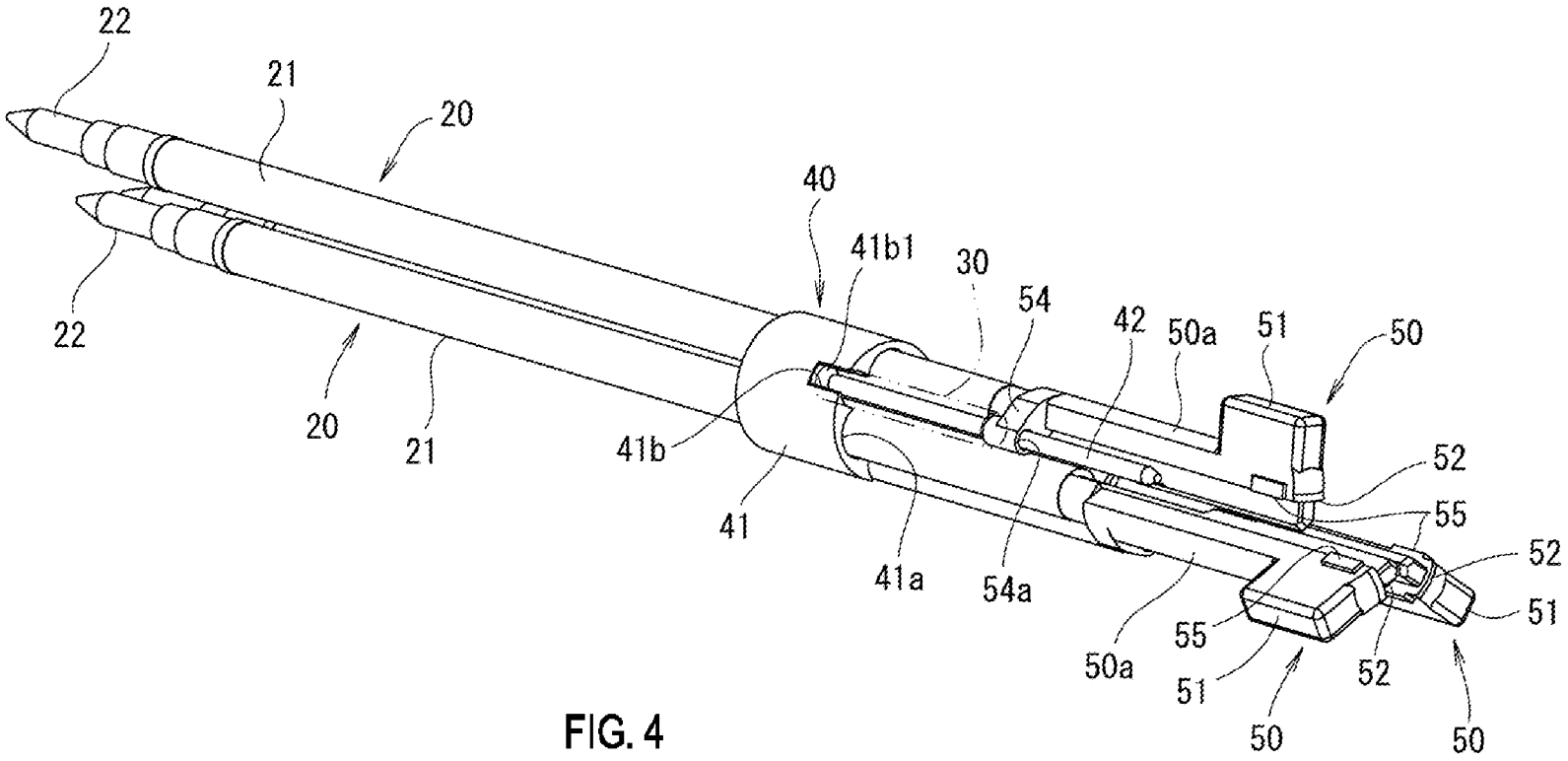
FIG. 4 is a perspective view showing the structures of main parts of the retractive writing utensil.

A second feature is that a coil spring having an outer diameter smaller than that of the core is used as the urging member (see FIGS. 2 to 4).

A third feature is that the urging member is a compression coil spring having the front end side locked directly or indirectly to the shaft tube and the rear end side locked directly or indirectly to the core (see FIGS. 2 to 4).

A fourth structure is that the shaft tube is provided with a guide shaft that is inserted through the urging member to guide the urging member to be stretched and contracted (see FIGS. 2 to 4).

A fifth structure is that a slide operation body that is slid to cause the core to protrude from the front end of the shaft tube is provided integrally with the core, and that the slide operation body is provided with a guided part that is fitted in the guide shaft and advanced or retreated (see FIGS. 2 to 6).

Figure 5:
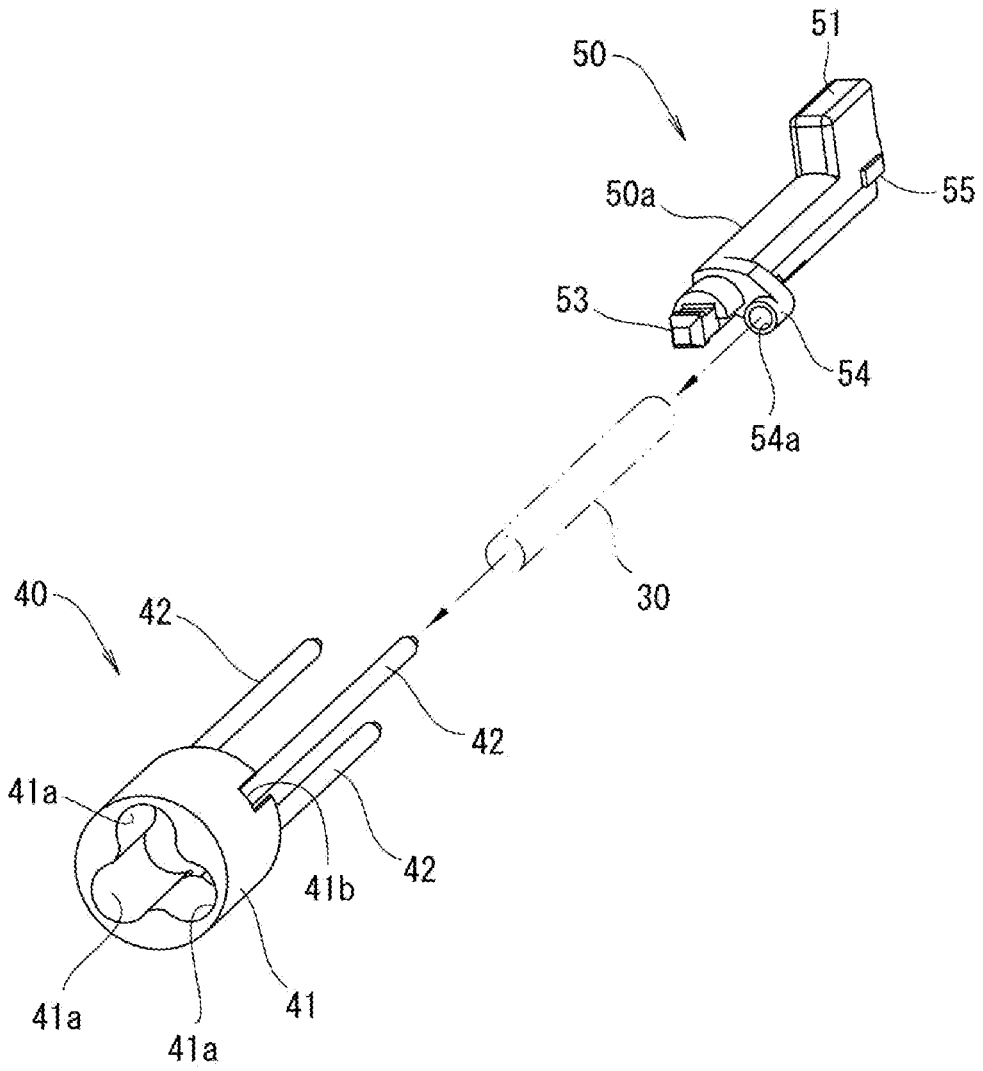
FIG. 5 is an exploded perspective view of the main parts of the retractive writing utensil.

A sixth structure is that a guide recessed part that fits the core radially inside the shaft tube and guides the core in a shaft tube axial direction is provided integrally with the shaft tube (see FIGS. 3 to 5).

A seventh feature is that a plurality of the cores are provided so as to line up in a shaft tube circumferential direction, and that the urging member is located near a valley between two cores adjacent to each other in the shaft tube circumferential direction (see FIGS. 3 and 4).

Specific Embodiments

Next, specific embodiments including the foregoing features are described in detail with reference to the drawings.

In the present specification, the shaft tube axial direction means the direction in which the center line of the shaft tube extends, and the shaft tube circumferential direction means the direction around the center line of the shaft tube. Furthermore, "front" means one side of the shaft tube axial direction where a writing part protrudes, and "rear" means the opposite side of the shaft tube axial direction.

The shaft tube radial direction means the diametrical direction of the shaft tube that is orthogonal to the center line of the shaft tube, radially outside the shaft tube means the direction away from the center of the shaft tube along the shaft tube radial direction, and radially inside the shaft tube means the direction toward the center of the shaft tube along the shaft tube radial direction.

The core radial direction means the diametrical direction of the core that is orthogonal to the center line of the core, radially outside the core means the direction away from the center of the core along the core radial direction, and radially inside the core means the direction toward the center of the core along the core radial direction.

A writing utensil A includes a shaft tube 10, a plurality of cores 20 stored in the shaft tube 10 in such a manner as to protrude from a front end of the shaft tube 10 when moved forward, an urging member 30 that is stretched and contracted in the shaft tube 10 in a front-rear direction, a core guide member 40 that guides each of the plurality of cores 20 in the front-rear direction, and a plurality of slide operation bodies 50 that are slid in order to selectively cause the plurality of cores 20 to protrude from the front end of the shaft tube.

The shaft tube 10 is configured in a long tubular shape extending from one or more tubular members in the front-rear direction. The shaft tube 10 illustrated includes a front shaft 11 having a tapered tubular tip part 11*a* at the front end side, and a rear shaft 12 screwed to a rear end side of the front shaft 11 and extending rearward. Reference numeral 13 in the drawings is a tubular elastic grip fitted to an outer peripheral part of the front shaft 11.

On a peripheral wall of a rear end of the rear shaft 12, a plurality of opening parts 12*a* (see FIGS. 1 and 2) for inserting the plurality of slide operation bodies 50 in the radial direction respectively are provided at predetermined intervals in the circumferential direction. Each opening part 12*a* is formed in a lateral concave notch shape so as to penetrate the peripheral wall of the rear shaft 12 in a long shape over the front-rear direction and have a rear end part opened rearward. This rear end open part of each opening part 12*a* is closed by a tail plug 60. Instead of the notch shape, each opening part 12*a* can also be formed into, for example, a long through-hole extending in the front-rear direction.

An inside surface of each opening part 12*a* is provided with a linear guide surface 12*c* that guides the corresponding slide operation body 50 in the front-rear direction, and a stepped locked part 12*b* to which the corresponding slide operation body 50, which has moved forward along the guide surface 12*c*, is dropped radially inside the shaft tube and locked.

Further, an inner wall surface of the rear end of the rear shaft 12 is provided with a step part 12*d* that receives a rear end surface of a guided part 54 of an operation part 51, and a guide shaft insertion hole 12*e* that is provided rearward on the step part 12*d*, and supports a rear end of a guide shaft 42 by having the rear end inserted thereto.

The plurality of cores 20 are provided around the central axis of the shaft tube 10 at substantially equal intervals in the circumferential direction (a total of three cores according to the example shown in FIG. 3).

These plurality of cores 20 are the cores of ballpoint pens of different colors. In each core 20, a writing part 22 (ballpoint pen tip) holding a transfer ball is connected to a front end side of an ink tank 21 filled with ink, and each core 20 is sometimes referred to as a ballpoint pen refill.

The cores 20 can also be, for example, cores (refills) or writing cores with functions other than the illustrated example, such as the cores for mechanical pencils or the writing cores for electronic pens.

The urging member 30 is located adjacent to the corresponding core 20 radially outward in such a manner that the center of the urging member 30 is positioned radially outside the core 20 (see FIG. 3), and urges the core 20 rearward. The urging member 30 illustrated is a compression coil spring having an outer diameter smaller than that of the cores 20.

In other words, the urging member 30 is not annularly mounted on the core 20, and the center of the urging member 30 is not located concentrically with the core 20. The urging member 30 is located slightly off of the core 20 in the radial direction of the shaft tube, is away from the core 20 in the radial direction of the shaft tube, and can be stretched and contracted in the front-rear direction.

In particular, according to a preferred example of the present embodiment, the urging member 30 is located closer to the valley between two slide operation bodies 50 and 50 that are adjacent to each other in the shaft tube circumferential direction (see FIGS. 3 to 4).

Also, the urging member 30 indirectly locks the front end side thereof to the shaft tube 10 via the core guide member 40, and indirectly locks the rear end side of the same to the core 20 via the slide operation body 50.

Figure 6:
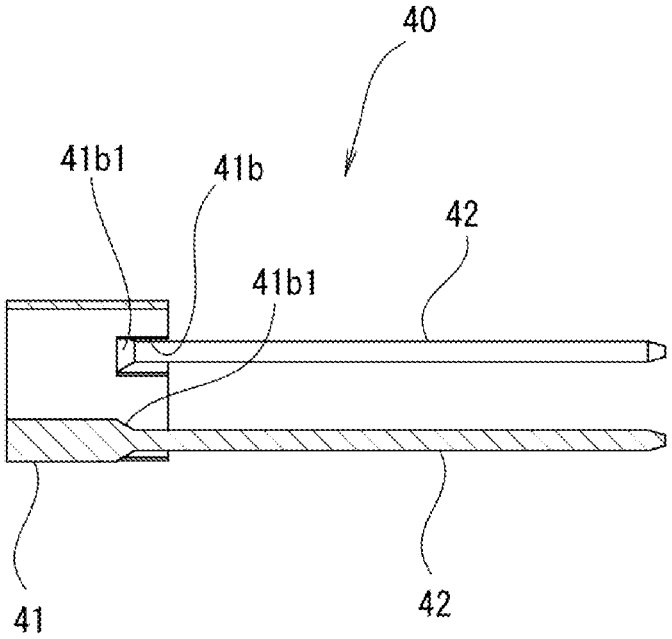
FIG. 6 is a vertical cross-sectional diagram showing an example of a core guide member having a guide shaft.

More specifically, the front end side of the urging member 30 is inserted into the spring receiving recessed part 41*b* of the core guide member 40, and the foremost end part thereof abuts on a spring receiving surface 41*b*1 (see FIG. 6). Furthermore, the rear end side of the urging member 30 is annularly fitted to the guided part 54 of the slide operation body 50 (see FIG. 5), and the rearmost end part of the same abuts on a front end surface of a slide main body part 50*a*.

The core guide member 40 is a member that is fixed near the middle in the shaft tube 10 in the front-rear direction and guides each core 20 in the front-rear direction. The core guide member 40 is often referred to as a divider.

The core guide member 40 integrally includes a substantially cylindrical main body part 41 that fits on an inner peripheral surface of the rear shaft 12, and a plurality of the guide shafts 42 extending rearward from the rear end side of the main body part 41.

A guide recessed part 41*a* that fits the core 20 radially inside the shaft tube and guides the core 20 in the shaft tube axial direction is provided on an inner peripheral surface of the main body part 41 (see FIG. 3).

A plurality of the guide recessed parts 41*a* (three, according to the illustrated example) are provided at intervals in the circumferential direction so as to correspond to the plurality of cores 20.

Each guide recessed part 41*a* is a concave groove with a semicircular cross section that extends in the front-rear direction, and is provided over the entire length of the main body part 41 in the axial direction.

Also, on the rear end side of the main body part 41, a plurality of (three, according to the example shown in FIG. 3) the spring receiving recessed parts 41*b* are provided so as to be located between the guide recessed parts 41*a*, 41*a* adjacent to each other in the circumferential direction.

Each spring receiving recessed part 41*b* is formed in a rearward opened concave shape so as to fit the front end side of the urging member 30. At a bottom part (front end part) in the spring receiving recessed part 41*b*, the conical spring receiving surface 41*b*1 protruding rearward is provided (see FIG. 6), and the corresponding guide shaft 42 protrudes rearward from a top (rear end part) of the spring receiving surface 41*b*1.

The spring receiving surface 41*b*1 holds the urging member 30 concentrically with the guide shaft 42 by receiving the front end part of the urging member 30 by means of a conical outer peripheral surface of the spring receiving surface 41*b*1.

Each guide shaft 42 extends rearward in the shape of a long cylindrical shaft and is inserted into the urging member 30 to guide the urging member 30 to be stretched and contracted in the front-rear direction. In addition, each guide shaft 42 inserts a part thereof behind the rear end side of the urging member 30 into the guided part 54 of the slide operation body 50 described hereinafter, to stabilize the movement of the slide operation body 50 in the front-rear direction.

The slide operation body 50 is detachably connected to the rear end of the core 20 so as to advance and retreat integrally with the core 20.

This slide operation body 50 integrally includes a long slide main body part 50*a* extending in the shaft tube 10 in the front-rear direction, and an operation part 51 that protrudes radially outside the shaft tube from the rear end side of the slide main body part 50*a* and is exposed to the outside of the shat tube, a sliding convex part 55 protruding radially inside the shaft tube in the slide main body part 50*a* and toward both sides of circumferential direction, a locking part 52 protruding rearward on the rearmost end side of the slide main body part 50*a*, a connecting part 53 fitted in the rear end of the core 20, and the guided part 54 that advances and retreats while being fitted annularly to the guide shaft 42 (see FIGS. 4 to 6).

Then, in the slide operation body 50, the operation part 51 is pushed forward, whereby the sliding convex part 55 moves forward and drops into the shaft tube while in sliding contact with the guide surface 12*c* in the shaft tube 10, locking the locking part 52 to the locked part 12*b* in the shaft tube (see FIG. 2). Then, when another slide operation body 50 moves forward in the locked state, the slide operation body 50 is brought into abutment with the moved slide operation body 50 to release the locked state.

The guided part 54 protrudes from the front end side of the slide main body part 50*a* toward one side in the shaft tube circumferential direction, and includes a through-hole 54*a* (see FIGS. 3 to 5) into which the guide shaft 42 is inserted.

When the guided part 54 moves rearward, the guided part 54 comes into abutment with the step part 12*d* in the rear shaft 12 so that the rearward distance of the guided part 54 is regulated. That is, when moving rearward, the slide operation body 50 brings the guided part 54 into abutment with the step part 12*d* without causing the rearmost end part to come into abutment with the tail plug 60, bringing its own good abutment sound and abutment vibration.

Note that the through-hole 54*a* can be replaced with a notch or the like that fits into the guide shaft 42.

The tail plug 60 is a member mounted onto the rear end part of the shaft tube 10 and closes a rear end opening of the shaft tube 10.

According to the illustrated example, the tail plug 60 is an integral member. However, the tail plug 60 can also have a form obtained by combining a plurality of members or can be a member integrally molded to the rear end part of the rear shaft 12.

Next, the characteristic actions and effects of the writing utensil A having the foregoing configuration will be described in detail.

When the slide operation body 50 is moved forward from its initial position shown in FIG. 2 by a hand or the like, the slide operation body 50 moves the guided part 54 linearly forward along the guide shaft 42 while elastically contracting the urging member 30, and is locked to the locked part 12*b* in the shaft tube 10 at the position that the guided part 54 moved to where the writing part 22 protrudes from the front end of the shaft tube 10.

In addition, when another slide operation body 50 moves forward, the slide operation body 50 in the locked state releases the locked state by being interrupted by the moved forward another slide operation body 50 and moves rearward by the urging force of the urging member 30. In this rearward as well, the guided part 54 is made to move along the guide shaft 42.

In this manner, the advance and retreat movement of the slide operation body 50 are linearly stabilized by the guided part 54 being fitted in and guided by the guide shaft 42.

Then, according to the configuration described above, since the urging member 30 is not mounted annularly to the core 20 but positioned adjacent to the core 20 so as to be substantially parallel thereto, the outer diameter of the urging member 30 can be made relatively small regardless of the outer diameter of the core 20. As a result, not only is it possible to increase the outer diameter of the ink tank 21 of the core 20 to increase the amount of ink, but also the diameter of the core 20 can be reduced to make the shaft tube 10 thinner.

In other words, the inner diameter of the urging member 30 can be made independent of the outer shape of the core 20.

In particular, according to a preferred example of the present embodiment, as shown in FIG. 3, the urging member 30 is arranged near the valley between the cores 20 and 20 adjacent to each other in the circumferential direction, and since the plurality of cores 20 are located closer to the center of the shaft tube 10 that does not have a partition wall or the like, it becomes easier to make the shaft tube 10 thinner.

Modifications

According to the embodiment described above, the front end side of the urging member 30 is indirectly locked to the shaft tube 10 via the core guide member 40, and the rear end side of the urging member 30 is indirectly locked to the core 20 via the slide operation body 50. However, as another example, the front end side of the urging member 30 may be locked directly to the shaft tube 10, and the rear end side of the urging member 30 may be locked directly to the core 20.

Furthermore, according to the embodiment described above, the guide shaft 42 is integrated with the core guide member 40, but as another example, an aspect is possible in which the guide shaft 42 is integrally provided on the shaft tube 10 or a separate guide shaft 42 is connected to the main body part 41 of the core guide member 40.

In addition, according to the embodiment described above, the guide recessed part 41*a* that guides the core 20 to advance and retreat is provided in the core guide member 40, but the guide recessed part 41*a* may be provided in the shaft tube 10 integrally, or in another example, the guide recessed part having the aforementioned configuration can be formed in the inner peripheral surface of the front shaft 11 or the rear shaft 12.

According to the embodiment described above, the plurality of cores 20 and urging members 30 are provided to configure a plurality of retractive writing utensils. However, in another example, one core 20 and one urging member 30 can be provided to configure one retractive writing utensil. Even in this case, since the diameter of the urging member 30 does not depend on the outer diameter of the core 20, the core 20 can be made thicker to increase the amount of ink, or the core 20 and the shaft tube 10 can be made thinner.

Furthermore, according to the embodiment described above, the urging member 30 is configured as a compression coil spring as a preferable example, but in another example of the urging member 30, aspects are possible in which the urging member 30 is made of an elastic material such as rubber or made of a tension spring that pulls the core 20 rearward.

The present invention is not limited to the foregoing embodiments and can be appropriately modified without changing the gist of the present invention.

What is claimed is:

1. A retractive writing utensil, comprising:

a shaft tube;

a core stored in the shaft tube in such a manner as to protrude from a front end of the shaft tube when moved forward; and an urging member that is stretched and contracted in the shaft tube in a front-rear direction, wherein the urging member is located adjacent to the core radially outward in such a manner that a center of the urging member is positioned radially outside the core, and urges the core rearward.

2. The retractive writing utensil according to claim 1, wherein a coil spring having an outer diameter smaller than that of the core is used as the urging member.

3. The retractive writing utensil according to claim 2, wherein the urging member is a compression coil spring having a front end side locked directly or indirectly to the shaft tube and a rear end side locked directly or indirectly to the core.

4. The retractive writing utensil according to claim 1, wherein the urging member is a compression coil spring having a front end side locked directly or indirectly to the shaft tube and a rear end side locked directly or indirectly to the core.

5. The retractive writing utensil according to claim 1, wherein a guide shaft that is inserted through the urging member to guide the urging member to be stretched and contracted is provided in the shaft tube.

6. The retractive writing utensil according to claim 5, wherein a slide operation body that is slid to cause the core to protrude from the front end of the shaft tube is provided integrally with the core, and the slide operation body being provided with a guided part that is fitted with the guide shaft to advance and retreat.

7. The retractive writing utensil according to claim 1, wherein a guide recessed part that fits the core radially inside the shaft tube to guide the core in a shaft tube axial direction is provided integrally with the shaft tube.

8. The retractive writing utensil according to claim 1, wherein a plurality of the cores are provided so as to line up in a shaft tube circumferential direction, and the urging member is located near a valley between two cores adjacent to each other in the shaft tube circumferential direction.

* * * * *